US010101068B2

(12) United States Patent
Lundberg et al.

(10) Patent No.: US 10,101,068 B2
(45) Date of Patent: Oct. 16, 2018

(54) SYSTEM AND METHOD FOR CHARGING REFRIGERANT INTO A REFRIGERATION CIRCUIT

(71) Applicants: Bosch Automotive Service Solutions Inc., Warren, MI (US); Robert Bosch GmbH, Stuttgart (DE)

(72) Inventors: Dylan M. Lundberg, Lonsdale, MN (US); Mark W. McMasters, Owatonna, MN (US)

(73) Assignees: Bosch Automotive Service Solutions Inc., Warren, MI (US); Robert Bosch GmbH, Stuttgart (DE)

( * ) Notice: Subject to any disclaimer, the term of this patent is extended or adjusted under 35 U.S.C. 154(b) by 252 days.

(21) Appl. No.: 14/940,611

(22) Filed: Nov. 13, 2015

(65) Prior Publication Data

US 2016/0138843 A1 May 19, 2016

Related U.S. Application Data

(60) Provisional application No. 62/079,083, filed on Nov. 13, 2014.

(51) Int. Cl.
*F25B 45/00* (2006.01)

(52) U.S. Cl.
CPC ..... *F25B 45/00* (2013.01); *F25B 2345/001* (2013.01); *F25B 2345/003* (2013.01); *F25B 2345/005* (2013.01)

(58) Field of Classification Search
CPC ..... F25B 45/00; F25B 2345/001; F25B 2345/003; F25B 2345/005
(Continued)

(56) References Cited

U.S. PATENT DOCUMENTS 4,688,388 A * 8/1987 Lower ..... B60H 1/00585 62/126
4,755,957 A * 7/1988 White ..... B60H 1/00585 62/126

(Continued)

OTHER PUBLICATIONS https://www.achrnews.com/articles/83925-get-the-air-out-of-that-refrigeration-system.*

(Continued)

*Primary Examiner* — Ljiljana Ciric
*Assistant Examiner* — Kirstin Oswald
(74) *Attorney, Agent, or Firm* — Maginot Moore & Beck LLP

(57) ABSTRACT

An air conditioning service system includes a refrigerant storage vessel, a charging subsystem fluidly connected to the refrigerant storage vessel and configured to connect to a refrigeration circuit to transfer refrigerant from the refrigerant storage vessel to the refrigeration circuit, a first pressure transducer configured to sense a first pressure in the refrigerant storage vessel, a first valve configured to control a flow of ambient air between the refrigerant storage vessel and the atmosphere, and a controller operably connected to the first pressure transducer and the first valve. The controller includes a memory and a processor configured to execute program instructions stored in the memory to operate the first valve to admit air into the refrigerant storage vessel based on the sensed first pressure, and to operate the charging subsystem to fluidly connect the refrigerant storage vessel to the refrigeration circuit.

17 Claims, 5 Drawing Sheets

(58) Field of Classification Search
USPC ..... 62/77, 149
See application file for complete search history.

(56) References Cited

U.S. PATENT DOCUMENTS 5,024,061 A * 6/1991 Pfeil, Jr. ..... F25B 45/00 62/292
5,127,232 A * 7/1992 Paige ..... F25B 45/00 62/149
5,189,881 A * 3/1993 Miles ..... F25B 45/00 165/104.19
5,222,369 A * 6/1993 Hancock ..... F25B 45/00 62/149
5,281,390 A * 1/1994 Gamo ..... C01B 3/0031 420/422
5,560,215 A * 10/1996 Talarico ..... B60H 1/00585 62/149
5,582,023 A * 12/1996 O'Neal ..... F25B 43/043 62/195
5,758,506 A * 6/1998 Hancock ..... B60H 1/00585 62/149
5,802,859 A * 9/1998 Zugibe ..... F25B 45/00 62/125
6,134,899 A * 10/2000 Brown ..... B60H 1/00585 62/126
8,616,011 B2 * 12/2013 Brown ..... B60H 1/00585 62/292
2013/0047635 A1 * 2/2013 Shultz ..... F25B 45/00 62/77
2013/0118189 A1 * 5/2013 Schoenoff ..... F25B 45/00 62/85
2013/0298578 A1 * 11/2013 McMasters ..... F25B 45/00 62/77

OTHER PUBLICATIONS https://inspectapedia.com/aircond/Refrigerant_Charging_Procedure.php.*
https://www.marineinsight.com/refrigeration-air-conditioning/how-to-charge-refrigeration-plant-on-ships/.*
https://www.hunker.com/12357845/how-to-charge-refrigeration-systems.*

* cited by examiner

SYSTEM AND METHOD FOR CHARGING REFRIGERANT INTO A REFRIGERATION CIRCUIT

CLAIM OF PRIORITY

This application claims priority to U.S. Provisional Application Ser. No. 62/079,083, entitled "System and Method for Charging Refrigerant into a Refrigeration Circuit," filed Nov. 13, 2014, the disclosure of which is hereby incorporated herein by reference in its entirety.

TECHNICAL FIELD

This disclosure relates generally to refrigeration systems, and more particularly to refrigerant service systems for refrigeration systems.

BACKGROUND

Air conditioning systems are currently commonplace in homes, office buildings and a variety of vehicles including, for example, automobiles. Over time, the refrigerant included in these systems becomes depleted and/or contaminated. As such, in order to maintain the overall efficiency and efficacy of an air conditioning system, the refrigerant included therein is periodically replaced or recharged.

Portable carts, also known as recover, recycle, recharge ("RRR") refrigerant service carts or air conditioning service ("ACS") units, are used in connection with servicing refrigeration circuits, such as the air conditioning unit of a vehicle. The portable machines include hoses coupled to the refrigeration circuit to be serviced. A vacuum pump and compressor operate to recover refrigerant from the vehicle's air conditioning unit, flush the refrigerant, and subsequently store the recovered refrigerant in a refrigerant storage tank, also referred to as an internal storage vessel or ISV. The refrigerant can then be used in another refrigeration system.

A typical ACS unit is further configured to charge the refrigeration circuit with a specified quantity of refrigerant from the ISV after the recovery operation is complete. During a charge operation, a valve between the ISV and the refrigeration circuit is opened, connecting the refrigeration circuit to the ISV. The refrigerant is stored in the ISV at the saturation pressure of the refrigerant at the temperature of the refrigerant in the ISV. The pressure differential between the ISV and the empty refrigeration circuit results in the refrigerant moving from the ISV into the refrigeration circuit.

In some instances, however, the pressure in the refrigeration circuit may equalize with the pressure in the ISV prior to the charge being completed. Since the charge relies solely on the pressure differential to transfer the refrigerant from the ISV to the refrigeration circuit, the charge stalls and no more refrigerant flows into the refrigeration circuit.

In some systems, the ACS unit performs a "power charge/recycle" operation to finish a charge after the charge has stalled. The refrigerant is cycled through a recovery path and the compressor, and moves back to the ISV. The compressor heats the refrigerant as it passes through, increasing the saturation temperature of the refrigerant and therefore enabling the refrigerant to flow from the ISV to the refrigeration circuit again. Performing a power charge/recycle operation, however, is time consuming and results in a substantial increase in the duration of the charging operation.

What is needed, therefore, is an ACS unit that can reduce the likelihood of a stalled charge condition and that can recover quickly from a stalled charge condition.

SUMMARY

In one embodiment, an air conditioning service system according to the disclosure includes a refrigerant storage vessel and a charging subsystem fluidly connected to the refrigerant storage vessel and configured to connect to a refrigeration circuit to transfer refrigerant from the refrigerant storage vessel to the refrigeration circuit. The air conditioning service system also includes a first pressure transducer configured to sense a first pressure in the refrigerant storage vessel, a first valve configured to control a flow of ambient air between the refrigerant storage vessel and the atmosphere, and a controller operably connected to the first pressure transducer and the first valve. The controller includes a memory and a processor configured to execute program instructions stored in the memory to operate the first valve to admit air into the refrigerant storage vessel based on the sensed first pressure, and to operate the charging subsystem to fluidly connect the refrigerant storage vessel to the refrigeration circuit. The admission of air into the refrigerant storage vessel advantageously increases the pressure in the refrigerant storage vessel, thereby reducing or eliminating the occurrence of stalling while charging a refrigeration circuit.

In another embodiment of the air conditioning service system the controller is further configured to determine whether the sensed first pressure is less than a first predetermined threshold and operate the first valve to open to admit air into the refrigerant storage vessel when the sensed first pressure is determined to be less than the first predetermined threshold.

In a further embodiment, the air conditioning service system further comprises an air vessel defining a chamber fluidly arranged between the first valve and the refrigerant storage vessel, and a compressor fluidly arranged between the chamber and the refrigerant storage vessel. The compressor is operably connected to the controller, and the controller is configured to operate the compressor to generate a vacuum in the chamber before operating the first valve to open, operate the first valve to open to admit the air into the chamber, operate the first valve to close, and operate the compressor to move the air from the chamber to the refrigerant storage vessel.

In yet another embodiment, the air conditioning service system further comprises a second pressure transducer configured to sense a second pressure in the chamber of the air vessel. After operating the first valve to open, the controller is configured to monitor the second pressure and wait until the second pressure equalizes before operating the first valve to close.

In some embodiments, the air conditioning service system further comprises a second valve fluidly arranged between the refrigerant storage vessel and the atmosphere. The controller is operably connected to the second valve and is configured to determine whether the first pressure is greater than a second pressure threshold, which is greater than the first pressure threshold, and to operate the second valve to open to expel air from the refrigerant storage vessel when the first pressure is determined to be greater than the second pressure threshold.

In one embodiment, the air conditioning service system further comprises a check valve fluidly arranged between the compressor and the refrigerant storage vessel. The check valve is configured to allow flow of the air only in the direction from the compressor to the refrigerant storage vessel.

In one particular embodiment of the air conditioning service system, the air vessel is an accumulator.

In another embodiment, the air conditioning service system further comprises an oil drain receptacle that is open to the atmosphere. The first valve is arranged in an oil drain line, which is fluidly arranged between the oil drain receptacle and the accumulator.

In some embodiments, the charge subsystem includes a third valve configured to control a fluid connection between the refrigerant storage vessel and a refrigeration circuit connected to the air conditioning service system. The controller is operably connected to the third valve and is configured to operate the third valve to open during a charging operation to fluidly connect the refrigerant storage vessel to the refrigeration circuit.

A method, according to the disclosure, of admitting air into a refrigerant storage vessel includes sensing a first pressure in the refrigerant storage vessel with a first pressure transducer and operating, with a controller, a first valve fluidly arranged between the refrigerant storage vessel and the atmosphere based on the sensed first pressure so as to admit air into the refrigerant storage vessel. The method further includes charging refrigerant into a refrigeration circuit by fluidly connecting the refrigerant storage vessel to a refrigeration circuit through a charging subsystem of the air conditioning service system. Admitting refrigerant into the refrigerant storage tank advantageously reduces or eliminates the occurrence of stalling while charging the refrigeration circuit.

In one embodiment, the method further comprises determining whether the sensed first pressure is less than a first predetermined threshold. The operating of the first valve includes operating the first valve to open to admit air into the refrigerant storage vessel when the sensed first pressure is determined to be less than the first predetermined threshold.

In another embodiment of the method, the operating of the first valve further comprises generating a vacuum in a chamber of an air vessel with a compressor, the chamber and the compressor being fluidly arranged between the first valve and the refrigerant storage vessel. The operating of the first valve also includes admitting the air into the chamber of the air vessel by operating the first valve to open, operating the first valve to close, and operating the compressor to move the air from the chamber to the refrigerant storage vessel.

In still another embodiment of the method, the operating of the first valve further comprises, after operating the first valve to open, sensing a second pressure in the chamber with a second pressure transducer, monitoring the sensed second pressure, and waiting until the second pressure stabilizes before operating the first valve to close.

In yet another embodiment, the method further comprises determining whether the first pressure is greater than a second pressure threshold, which is greater than the first pressure threshold, and venting air from the refrigerant storage vessel by operating a second valve, which is fluidly arranged between the refrigerant storage vessel and the atmosphere, to open when the first pressure is determined to be greater than the second pressure threshold.

In one particular embodiment of the method, the air vessel is an accumulator.

In another embodiment, a method for charging refrigerant into a refrigeration circuit, comprises admitting air into a refrigerant storage vessel to increase a pressure in the refrigerant storage vessel, generating a vacuum in the refrigeration circuit, connecting the refrigeration circuit to the refrigerant storage vessel to move refrigerant from the refrigerant storage vessel to the refrigeration circuit due to a pressure differential between the refrigerant storage vessel and the refrigeration circuit, and admitting air into the refrigerant storage vessel to maintain the pressure differential until the refrigeration circuit charged with a desired quantity of refrigerant. The method advantageously maintains a pressure differential between the refrigerant storage vessel and the refrigeration circuit so as to enable the desired quantity of refrigerant to be charged into the refrigeration circuit.

The first valve may be, for example, an oil drain valve, the second valve may be, for example, a purge valve, and the third valve may be, for example, a charge valve.

DETAILED DESCRIPTION

For the purposes of promoting an understanding of the principles of the embodiments described herein, reference is now made to the drawings and descriptions in the following written specification. No limitation to the scope of the subject matter is intended by the references. This disclosure also includes any alterations and modifications to the illustrated embodiments and includes further applications of the principles of the described embodiments as would normally occur to one skilled in the art to which this document pertains.

Figure 1:
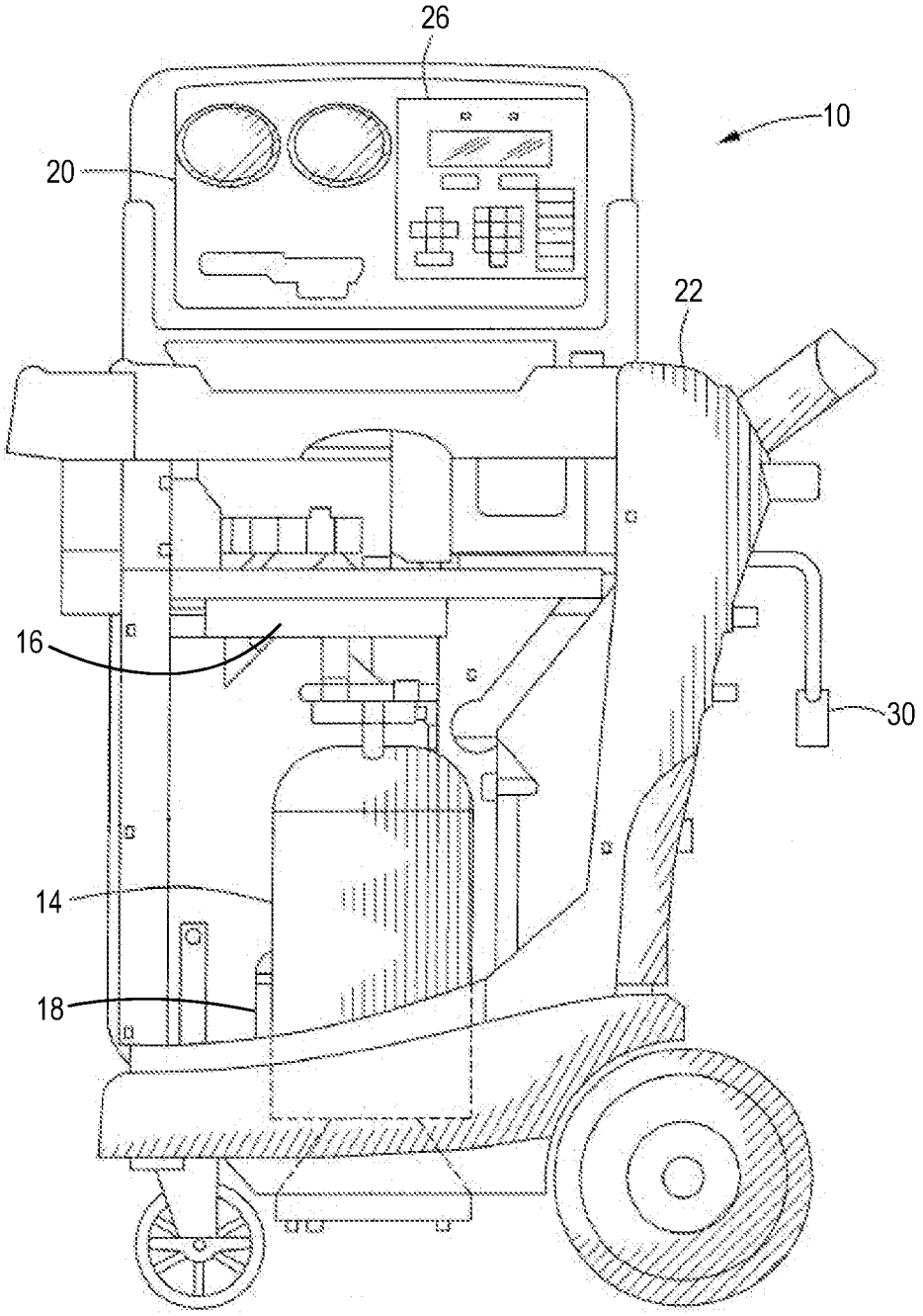
FIG. 1 is a partial cutaway front view of an air conditioning service system according to the disclosure.

FIG. 1 is an illustration of an air conditioning service ("ACS") system 10 according to the disclosure. The ACS system 10 includes a refrigerant container or internal storage vessel ("ISV") 14 (also referred to herein as a "refrigerant storage vessel"), a manifold block 16, a compressor 18, a control module 20, and a housing 22. The exterior of the control module 20 includes an input/output unit 26 for input of control commands by a user and output of information to the user. Hose connections 30 (only one is shown in FIG. 1) protrude from the housing 22 to connect to service hoses that connect to an air conditioning ("A/C") circuit, for example A/C circuit 40 (FIG. 2) of vehicle 50, and facilitate transfer of refrigerant between the ACS system 10 and the A/C circuit. The manifold block 16 is fluidly connected to the ISV 14, the compressor 18, and the hose connections 30 through a series of valves, hoses, and tubes, discussed in further detail below.

The ISV 14 is configured to store refrigerant for the ACS system 10. No limitations are placed on the kind of refrigerant that may be used in the ACS system 10. As such, the ISV 14 is configured to accommodate any refrigerant that is desired to be charged to the A/C circuit. In some embodiments, the ISV 14 is particularly configured to accommodate one or more refrigerants that are commonly used in the A/C systems of vehicles (e.g., cars, trucks, boats, planes, etc.), for example R-134a, $CO_2$ (also known as R-744), or R-1234yf. In some embodiments, the ACS unit has multiple ISV tanks configured to store different refrigerants.

Figure 2:
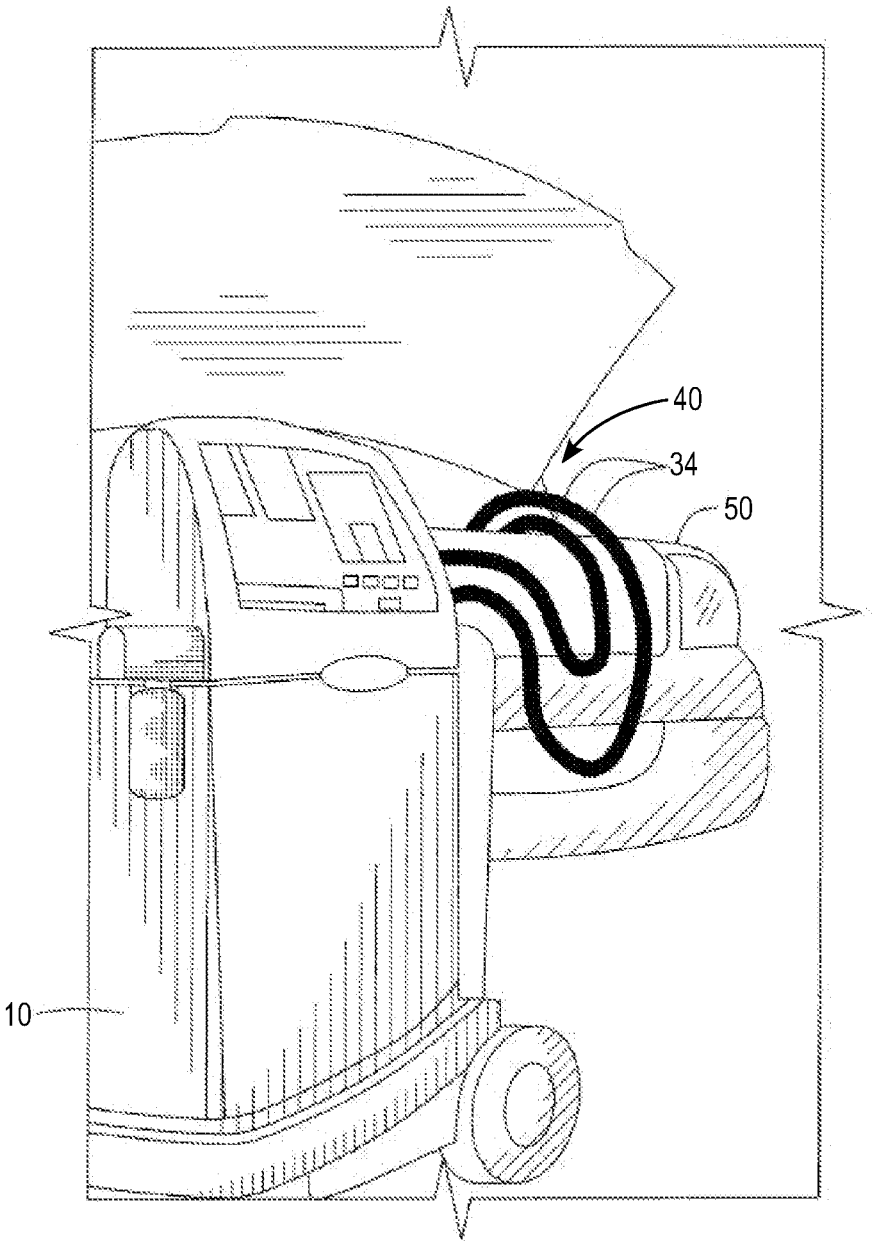
FIG. 2 is side perspective view of the ACS system of FIG. 1 connected to a vehicle.

FIG. 2 is an illustration of a portion of the ACS system 10 illustrated in FIG. 1 connected to an air conditioning circuit 40 of a vehicle 50. One or more service hoses 34 connect an inlet and/or outlet port of the A/C circuit 40 of the vehicle 50 to the hose connections 30 (shown in FIG. 1) of the ACS system 10.

Figure 3:
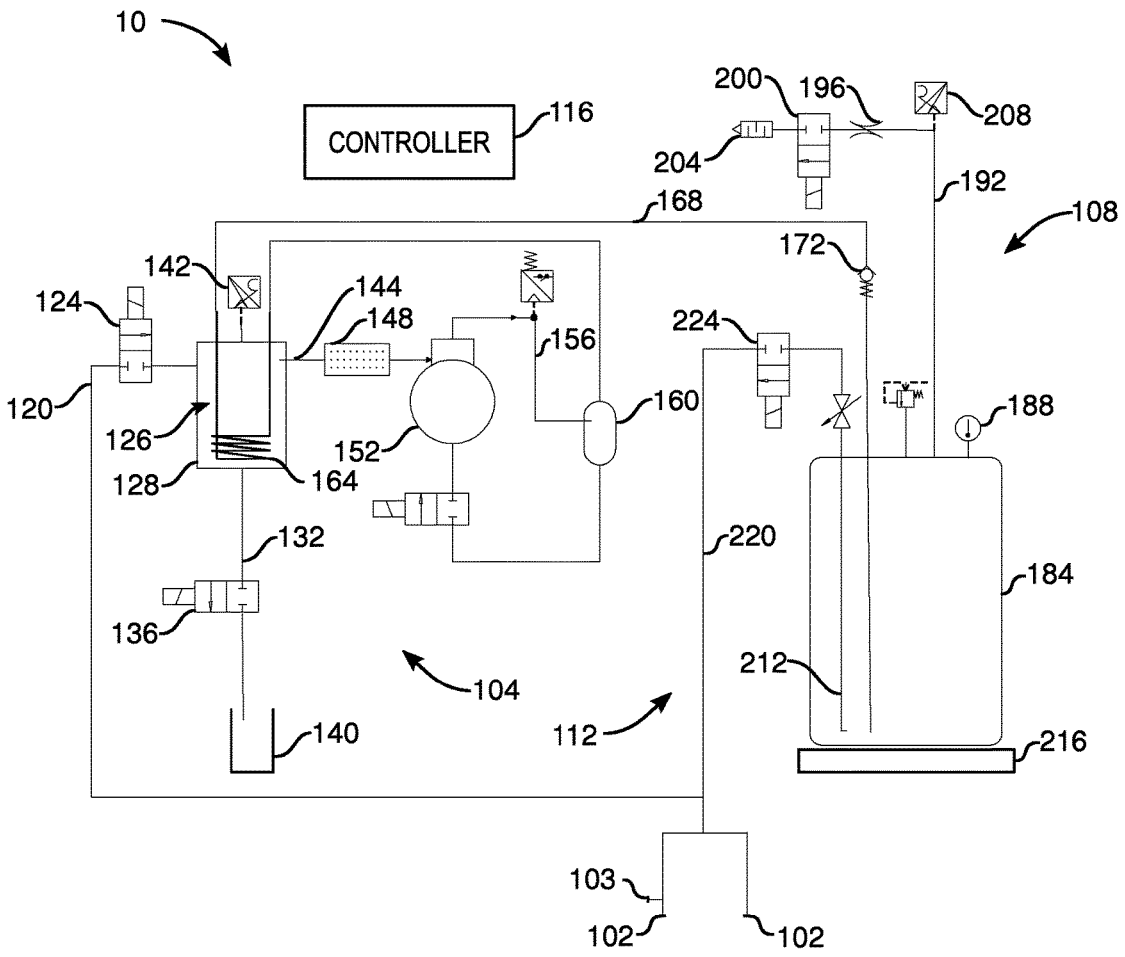
FIG. 3 is a schematic view of the ACS system according to the disclosure configured to vent refrigerant to the atmosphere through control orifices.

FIG. 3 illustrates a schematic view of the ACS system 10 according to the disclosure. The ACS system 10 includes service couplers 102, a recovery circuit 104, a refrigerant storage subsystem 108, a charging subsystem 112, and a controller 116, which may be incorporated in the control module 20. The service couplers 102 may be located at the hose couplers 30, and are configured to connect to service hoses, for example the service hoses 34 shown in FIG. 2, to connect the ACS system 10 to an air conditioning circuit, for example A/C circuit 40. In some embodiments, one or both of the service couplers include an air inlet valve 103 configured to be operated manually to allow air into the ACS system 10.

The recovery circuit 104 includes an inlet line 120 connected to the air conditioning circuit via the couplers 102. A recovery solenoid valve 124 is connected to the inlet line 120 to control the flow of refrigerant through the inlet line 120 from the air conditioning circuit into the recovery circuit 104. The inlet line 120 feeds into a chamber 126 of an accumulator 128, which removes system oil that is entrained in the refrigerant during normal operation of the A/C circuit. The removed system oil flows through an oil drain line 132, an oil drain solenoid valve 136, and into an oil drain receptacle 140.

An accumulator pressure transducer 142 is connected to the accumulator 128 and is configured to generate an electronic signal corresponding to the pressure in the chamber 126 of the accumulator 128. Refrigerant exits the accumulator chamber 126 into a compressor inlet line 144, passing through a filter and dryer unit 148 and to an inlet of a compressor 152. A compressor outlet line 156 connects an outlet of the compressor 152 through a compressor oil separator 160 and into a heat exchanger 164 located in the chamber 126 of the accumulator 128. The heat exchanger 164 is connected to a recovery outlet line 168, through which the refrigerant flows, via a check valve 172, to the refrigerant storage subsystem 108.

The refrigerant storage subsystem 108 includes a refrigerant storage vessel (or "ISV") 184, into which refrigerant flows from the recovery circuit 104. The ISV 184 includes a temperature sensor 188 configured to generate an electronic signal corresponding to a temperature in the ISV 184. An air bleed line 192 exits from the top of the ISV 184, through an orifice 196, a purge solenoid valve 200, an air diffuser 204, to be vented to the atmosphere. A pressure transducer 208 is configured to sense the pressure in the air bleed line 192 between the orifice 196 and the ISV 184 and generate an electronic signal corresponding to the pressure in the ISV 184. An ISV discharge line 212 pulls liquid refrigerant from the lower portion of the ISV 184 into the charging subsystem 112. The refrigerant storage system 108 further includes a scale 216 configured to generate an electronic signal corresponding to a weight of the ISV 184.

The charging subsystem 112 includes a charge line 220 connected to the ISV discharge line 212. The charge line 220 connects the ISV 184, via a charge solenoid valve 224 and service couplers 102, to the air conditioning circuit to enable charging of the air conditioning circuit.

Figure 4:
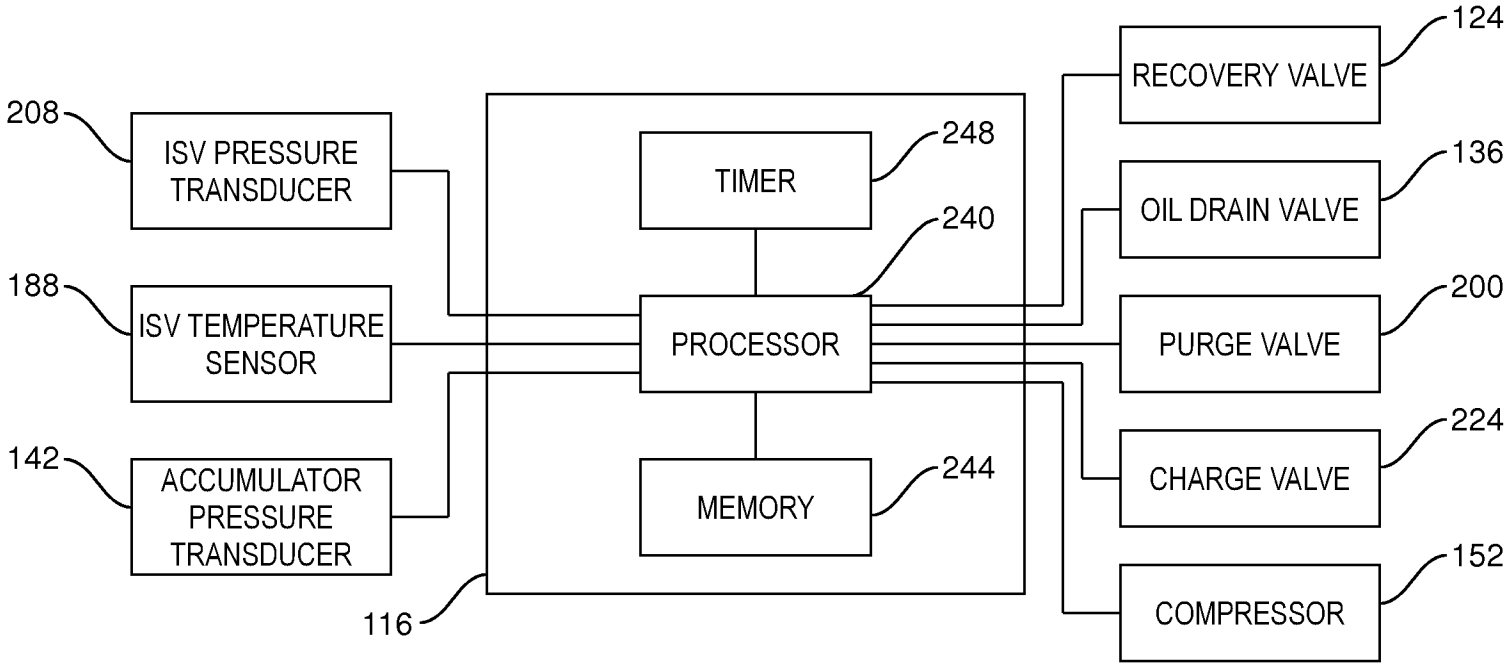
FIG. 4 is a schematic view of the control components of the ACS machine of FIG. 3.

FIG. 4 is a schematic diagram of the controller 116 and the components communicating with the controller 116 in the ACS system 10. Operation and control of the various components and functions of the ACS system 10 are performed with the aid of the controller 116. The controller 116 is implemented with a general or specialized programmable processor 240 that executes programmed instructions. In some embodiments, the controller includes more than one general or specialized programmable processor. The instructions and data required to perform the programmed functions are stored in a memory unit 244 associated with the controller 116, which may be integral with the controller 116 (as shown in FIG. 4) or may be a separate unit. The processor 240, memory 244, and interface circuitry configure the controller 116 to perform the functions and processes described below. These components can be provided on a printed circuit card or provided as a circuit in an application specific integrated circuit (ASIC). Each of the circuits can be implemented with a separate processor or multiple circuits can be implemented on the same processor. Alternatively, the circuits can be implemented with discrete components or circuits provided in VLSI circuits. Also, the circuits described herein can be implemented with a combination of processors, ASICs, discrete components, or VLSI circuits.

The controller 116 is operatively connected to the ISV temperature sensor 188, the accumulator and ISV pressure transducers 142 and 208, respectively, the ISV scale 216, the solenoid valves 124, 136, 200, and 224, and the compressor 152. The accumulator and ISV pressure transducers 142, 208 transmit the electronic signals representing the sensed pressure in the accumulator chamber 126 and the ISV 184, respectively, to the processor 240. Likewise, the ISV scale 216 transmits the electronic signals representing the sensed weight in the ISV 184 to the processor 240 and the ISV temperature sensor 188 transmits the electronic signals corresponding to the temperature in the ISV 184 to the processor 240. The processor 240 obtains the signals at predetermined time intervals or as necessary to perform computations, and stores relevant values from the transducer, scale, and temperature sensor in the memory 244.

The processor 240 is configured to transmit electronic signals that instruct the solenoid valves 124, 136, 200, 224 to operate to open or close and to transmit electronic signals to the compressor 152 to operate the compressor 152 to activate and deactivate. The controller 116 may include a timer 248, which may be integral with the controller 116, as illustrated in FIG. 4, or may be embodied as a separate timer circuit.

In another embodiment, the programmed functions are stored remotely in a different database or memory outside the ACS system 10. The functions stored in the remote database or the memory that is supported by a device may be retrieved or transmitted to the processor via a network, either wireless, wired, shared, or private. The device can be an electronic device such as a tablet, mobile phone, laptop, a diagnostic system, a wearable device, a personal computer, or the like. In yet another embodiment, the device includes a processor configured to retrieve the functions stored in the remote memory and to transmit the electronic signals to the internal components of the ACS system 10 to perform one or more actions. In further embodiment, the ACS system 10 is remotely controlled by a controller of a device such as a portable electronic device. The remote controller performs identical functions described above.

During servicing of an air conditioning circuit, the ACS system 10 is configured to recover refrigerant from the air conditioning circuit 40. A technician connects the service hoses 34 to the service ports of the air conditioning circuit 40 and to the service couplers 102 at the hose connections 30. The controller 116 operates the recovery solenoid 124 to open, allowing refrigerant from the air conditioning circuit 40 to flow into the recovery circuit 104 via the inlet line 120. The refrigerant is purified in the recovery circuit 104 and then moved through the recovery outlet line 168 to be stored in the ISV 184.

In some refrigerant service systems, air entrained in the recovered refrigerant may enter the refrigerant service system, or may be transferred from a leaking refrigeration circuit into the refrigerant service system. In conventional refrigerant service systems, non-condensable air in the ISV is viewed as a problem, and is therefore removed. If air is detected in a conventional refrigerant service system, an air purge operation is initiated, during which a purge valve is opened and air in the ISV is vented to the atmosphere.

After the refrigerant is recovered, maintenance on the air conditioning circuit is complete, and the air conditioning circuit is pulled to a vacuum, the ACS system 10 according to the disclosure is configured to charge the air conditioning circuit 40 with a predetermined quantity of refrigerant. The controller 116 opens the charge solenoid valve 224, connecting the ISV 184 through the charge line 220 and the couplers 102 to the air conditioning circuit. Since the air conditioning circuit 40 has a lower pressure than the ISV 184, the refrigerant flows from the ISV 184 into the air conditioning circuit 40.

As a charge operation is performed, the pressure in the ISV 184 must remain above the pressure in the air conditioning circuit or the refrigerant will cease to flow into the air conditioning circuit 40, a condition known in the art as a "stall." The ACS system 10 according to the disclosure is configured to introduce a predetermined quantity of ambient air into the ISV 184 and maintain this quantity of air to increase the pressure in the ISV 184 and reduce the likelihood of a stall occurring in the charge operation. In some embodiments according to the disclosure, air is introduced into the ISV 184 during the initial tank filling process so that the tank will have an adequate quantity of air from the beginning of its life.

Figure 5:
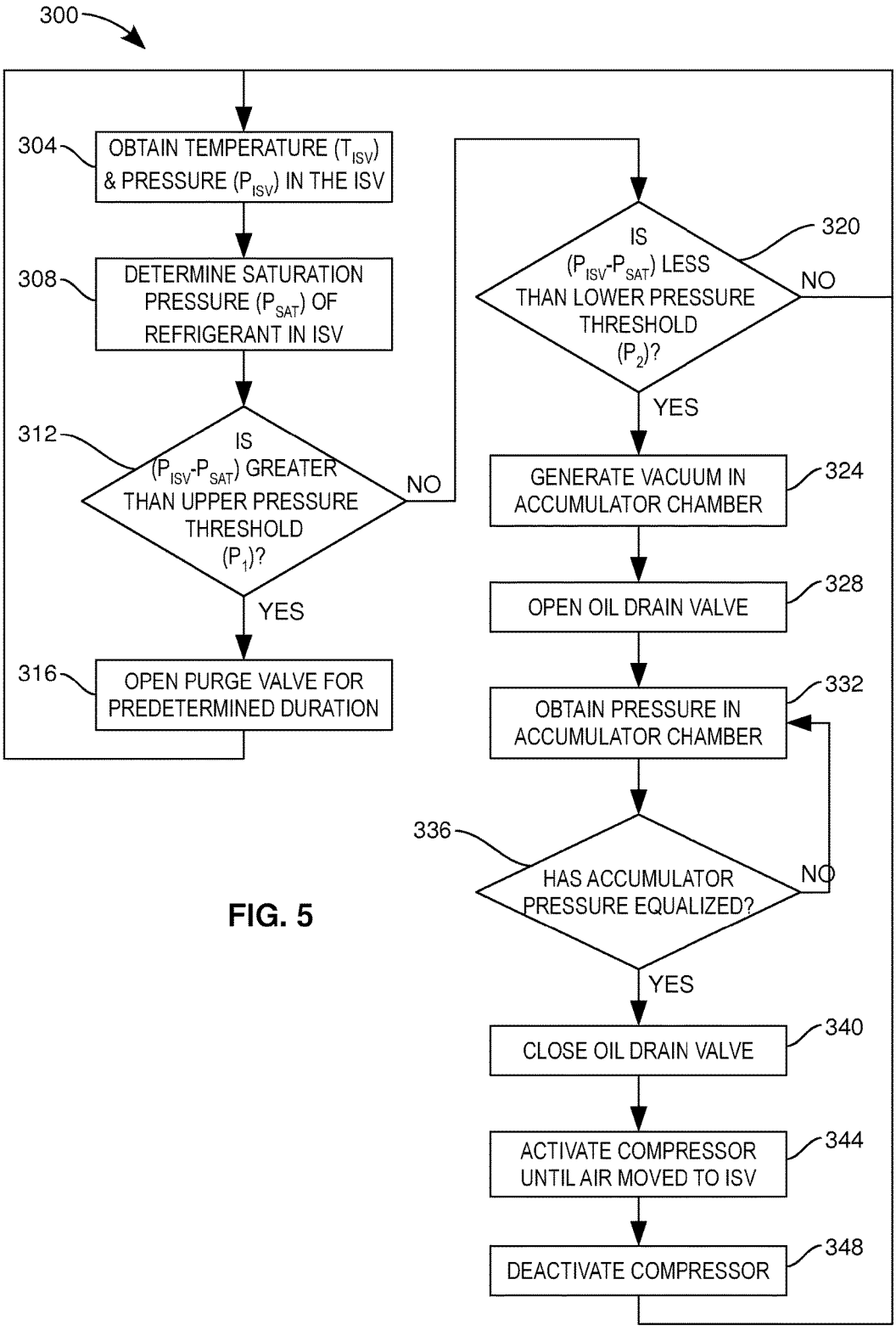
FIG. 5 is a process diagram of a method of operating an ACS machine during a charging operation.

FIG. 5 illustrates a method 300 of operating an embodiment of an ACS system, such as the ACS system 10 described above with reference to FIGS. 3 and 4, during a charge operation to retain a predetermined quantity of air in the ISV 184. The method 300 begins with the controller obtaining the temperature and pressure in the ISV (block 304). The temperature is obtained from a temperature sensor in the ISV, for example temperature sensor 188 in ISV 184, and the pressure is obtained from a pressure transducer in or fluidly connected to the ISV, for example ISV pressure transducer 208 connected to ISV 184.

The controller 116 then determines the saturation pressure of the refrigerant in the ISV 184 (block 308). The saturation pressure of the refrigerant is a function of only the temperature in the ISV. The saturation pressure is determined by the processor 240 recalling the saturation pressure value from a table or graph of the saturation pressure vs. temperature for the particular refrigerant being used, which is stored in the memory 244.

The process 300 then proceeds to determine whether the difference between the obtained ISV pressure ($P_{ISV}$) and the saturation pressure ($P_{SAT}$) is greater than an upper pressure threshold ($P_1$) (block 312). Since the refrigerant in the ISV is condensed, or in a liquid state, a tank full of pure refrigerant will have a pressure equal to the determined saturation pressure. Air, on the other hand, is not condensable. As a result, any air in the ISV 184 remains in a gaseous state, and will therefore gain pressure based upon the quantity of air in the ISV 184.

If the obtained ISV pressure is greater than the determined saturation pressure of the refrigerant, the difference is assumed to be due to a quantity of non-condensable air present in the ISV 184. The upper pressure threshold is selected as a pressure at which the maximum desired quantity of air is present in the ISV 184. Upon the difference between the ISV pressure and the refrigerant saturation pressure exceeding the upper pressure threshold, the controller is configured to open the purge valve 200 for a predetermined duration (block 316). Opening the purge valve 200 bleeds air from the ISV 184 in a controlled manner, reducing the ISV pressure. The process then continues at block 304.

If the difference between the ISV pressure and the saturation pressure is not greater than the upper pressure threshold, the controller 116 then determines whether the difference between the ISV pressure and the saturation pressure is less than a lower threshold ($P_2$) (block 320). As discussed above, the ACS system 10 according to the disclosure is configured to retain a predetermined quantity of air in the ISV 184 to increase the pressure therein, thereby reducing the likelihood that the pressure in the ISV 184 will equalize with the pressure in the air conditioning circuit being serviced. The lower pressure threshold is the difference between the ISV and saturation pressures at the minimum quantity of air desired to remain in the ISV 184. If the difference between the ISV and saturation pressures is not less than the lower pressure threshold, then the pressure difference is between the upper and lower thresholds and process continues at block 304. If the quantity of air falls below the desired quantity, or the difference between the ISV pressure and the refrigerant saturation pressure is less than the lower pressure threshold, the ACS system 10 is configured to introduce air into the ISV 184.

In some embodiments, the controller is configured to compare only the ISV pressure with upper and lower pressure thresholds in blocks 312 and 320. In such an embodiment, the controller need not obtain the temperature in the ISV or determine the saturation pressure of refrigerant in the ISV. The controller maintains the pressure in the ISV between the upper and lower thresholds, regardless of the temperature in the ISV or the saturation pressure of the refrigerant.

The controller 116 introduces air into the ISV 184 by first generating a vacuum in a chamber of an air vessel, which, in the illustrated embodiment, is the chamber 126 of the accumulator 128 (block 324). The vacuum may be generated by a compressor, for example compressor 152, or a vacuum pump (not shown) connected to the chamber 126 of the accumulator 128. Once the accumulator chamber 126 is at a desired vacuum pressure, the controller 116 opens the oil drain valve 136 (block 328). Since the oil drain receptacle 140 is open to the atmosphere, opening the oil drain valve 136 enables air to enter the chamber 126 of the accumulator 128 through the oil drain line 132. The controller 116 obtains the pressure in the chamber 126 with the pressure transducer 142 (block 332) and determines whether the accumulator pressure has equalized (block 336). If the pressure has not equalized, meaning the pressure is still rising in the accumulator chamber 126, then the process continues at block 332. If the pressure has equalized, then the chamber 126 is filled with air at atmospheric pressure, and the controller 116 proceeds to close the oil drain valve 136 (block 340).

In some embodiments, the controller 116 is configured to leave the oil drain valve open 136 for a predetermined time instead of actively monitoring the pressure in the accumulator, as in blocks 332 and 336. The predetermined time may be selected as a time in excess of a known time required for the pressure to equalize in the accumulator. In other embodiments, instead of opening and closing the oil drain valve, the system may include another valve connecting the accumulator to the atmosphere. For example, one or more valves may connect the air inlet 103 to the accumulator chamber 126.

The process continues with the controller 116 activating the compressor 152 to move the air from the chamber 126 into the ISV 184 (block 344), and then deactivating the compressor 152 (block 348) once the air has been moved to the ISV 184. In some embodiments, the compressor 152 is activated for a predetermined duration to move the air to the ISV 184, while in other embodiments, the controller 116 monitors the pressure in the accumulator chamber 126, as in blocks 332 and 336, to determine whether the air has been moved to the ISV 184.

The process 300 described above may be performed continuously by the ACS system 10 at all times, or the process 300 may be performed only during a charge operation or immediately before the charge operation. The ACS system 10 may also be configured to perform the process at predetermined intervals, which, in some instances, may be shorter during a charge operation and longer while the ACS system 10 is idle.

The ACS system 10 and the process 300 according to the disclosure maintains a predetermined quantity of air in the ISV tank 184. The air in the tank 184 increases the overall pressure in the ISV tank 184, thereby supplementing the pressure differential between the ISV 184 and the air conditioning circuit 40. As a result, the pressure differential between the ISV 184 and the air conditioning circuit 40 should be great enough to avoid or minimize stall conditions during charging operations.

In addition, since the pressure in the ISV tank 184 is monitored and maintained within a predetermined range, the quantity of refrigerant charged is determined more accurately than in conventional ACS units. The refrigerant is charged into the system through a series of pulses, during which the quantity of refrigerant transferred to the air conditioning circuit is related to the pressure differential between the ISV 184 and the air conditioning circuit 40. Maintaining the pressure in the ISV 184 at a consistent pressure range above the saturation pressure results in the refrigerant transferred at each pulse being more consistent and enables the system 10 to track the quantity of refrigerant transferred more precisely.

It will be appreciated that variants of the above-described and other features and functions, or alternatives thereof, may be desirably combined into many other different systems, applications or methods. Various presently unforeseen or unanticipated alternatives, modifications, variations or improvements may be subsequently made by those skilled in the art that are also intended to be encompassed by the foregoing disclosure.

The invention claimed is:

1. An air conditioning service system comprising:

a refrigerant storage vessel configured to store a refrigerant;

a charging subsystem fluidly connected to the refrigerant storage vessel and configured to connect to a refrigeration circuit to transfer refrigerant from the refrigerant storage vessel to the refrigeration circuit;

a first pressure transducer configured to sense a first pressure in the refrigerant storage vessel;

a first valve configured to control a flow of ambient air between the refrigerant storage vessel and the atmosphere; and a controller operably connected to the first pressure transducer and the first valve, the controller including a memory and a processor configured to execute program instructions stored in the memory to operate the first valve to admit air into the refrigerant storage vessel based on the sensed first pressure, and to operate the charging subsystem to fluidly connect the refrigerant storage vessel to the refrigeration circuit.

2. The air conditioning service system of claim 1, wherein the controller is further configured to determine whether the sensed first pressure is less than a first predetermined threshold and operate the first valve to open to admit air into the refrigerant storage vessel when the sensed first pressure is determined to be less than the first predetermined threshold.

3. The air conditioning service system of claim 2, further comprising:

an air vessel defining a chamber fluidly arranged between the first valve and the refrigerant storage vessel; and a compressor fluidly arranged between the chamber and the refrigerant storage vessel, the compressor being operably connected to the controller, wherein the controller is further configured to operate the compressor to generate a vacuum in the chamber before operating the first valve to open, operate the first valve to open to admit the air into the chamber, operate the first valve to close, and operate the compressor to move the air from the chamber to the refrigerant storage vessel.

4. The air conditioning service system of claim 3, further comprising:

a second pressure transducer configured to sense a second pressure in the chamber of the air vessel, wherein, after operating the first valve to open, the controller is configured to monitor the second pressure and wait until the second pressure equalizes before operating the first valve to close.

5. The air conditioning service system of claim 4, further comprising:

a second valve fluidly arranged between the refrigerant storage vessel and the atmosphere, wherein the controller is operably connected to the second valve and is configured to determine whether the first pressure is greater than a second pressure threshold, which is greater than the first pressure threshold, and to operate the second valve to open to vent air from the refrigerant storage vessel when the first pressure is determined to be greater than the second pressure threshold.

6. The air conditioning service system of claim 3, further comprising:

a check valve fluidly arranged between the compressor and the refrigerant storage vessel, the check valve being configured to allow flow of the air only in a direction from the compressor to the refrigerant storage vessel.

7. The air conditioning service system of claim 3, wherein the air vessel is an accumulator.

8. The air conditioning service system of claim 7, further comprising:

an oil drain receptacle that is open to the atmosphere, wherein the first valve is arranged between the oil drain receptacle and the accumulator in an oil drain line, which fluidly connects the oil drain receptacle and the accumulator.

9. The air conditioning service system of claim 7, wherein, when the controller operates the first valve to admit air into the refrigerant storage vessel, the refrigerant storage vessel is fluidly connected to the atmosphere so as to admit ambient air into the refrigerant storage vessel.

10. The air conditioning service system of claim 1, wherein:

the charging subsystem includes a third valve configured to control a fluid connection between the refrigerant storage vessel and a refrigeration circuit connected to the air conditioning service system; and the controller is operably connected to the third valve and is configured to operate the third valve to open during a charging operation to fluidly connect the refrigerant storage vessel to the refrigeration circuit.

11. A method of operating an air conditioning service system, comprising:

sensing a first pressure in a refrigerant storage vessel with a first pressure transducer;

operating, with a controller, a first valve fluidly arranged between the refrigerant storage vessel and the atmosphere based on the sensed first pressure so as to fluidly connect the refrigerant storage vessel to the atmosphere and admit ambient air into the refrigerant storage vessel; and charging refrigerant into a refrigeration circuit by fluidly connecting the refrigerant storage vessel to a refrigeration circuit through a charging subsystem of the air conditioning service system.

12. The method of claim 11, further comprising:

determining whether the sensed first pressure is less than a first predetermined threshold, wherein the operating of the first valve includes operating the first valve to open to admit ambient air into the refrigerant storage vessel when the sensed first pressure is determined to be less than the first predetermined threshold.

13. The method of claim 12, the operating of the first valve further comprising:

generating a vacuum in a chamber of an air vessel with a compressor, the chamber and the compressor being fluidly arranged between the first valve and the refrigerant storage vessel;

admitting the ambient air into the chamber of the air vessel by operating the first valve to open;

operating the first valve to close; and operating the compressor to move the air from the chamber to the refrigerant storage vessel.

14. The method of claim 13, the operating of the first valve further comprising:

after operating the first valve to open:

sensing a second pressure in the chamber with a second pressure transducer;

monitoring the sensed second pressure; and waiting until the second pressure stabilizes before operating the first valve to close.

15. The method of claim 14, further comprising:

determining whether the first pressure is greater than a second pressure threshold, which is greater than the first pressure threshold;

venting air from the refrigerant storage vessel by operating a second valve, which is fluidly arranged between the refrigerant storage vessel and the atmosphere, to open when the first pressure is determined to be greater than the second pressure threshold.

16. The method of claim 13, wherein the air vessel is an accumulator.

17. A method for charging refrigerant into a refrigeration circuit, comprising:

admitting ambient air from the atmosphere into a refrigerant storage vessel to increase a pressure in the refrigerant storage vessel;

generating a vacuum in the refrigeration circuit;

connecting the refrigeration circuit to the refrigerant storage vessel to move refrigerant from the refrigerant storage vessel to the refrigeration circuit due to a pressure differential between the refrigerant storage vessel and the refrigeration circuit; and admitting ambient air into the refrigerant storage vessel from the atmosphere to maintain the pressure differential until the refrigeration circuit charged with a desired quantity of refrigerant.

* * * * *